US009952014B2

(12) United States Patent
Omre

(10) Patent No.: US 9,952,014 B2
(45) Date of Patent: Apr. 24, 2018

(54) VIBRATION DAMPER

(71) Applicant: EXAPOINT SVENSKA AB, Stockholm (SE)

(72) Inventor: Kent Omre, Stockholm (SE)

(73) Assignee: EXAPOINT SVENSKA AB (SE)

( * ) Notice: Subject to any disclaimer, the term of this patent is extended or adjusted under 35 U.S.C. 154(b) by 0 days.

(21) Appl. No.: 15/547,430

(22) PCT Filed: Jan. 28, 2016

(86) PCT No.: PCT/EP2016/051805
§ 371 (c)(1),
(2) Date: Jul. 28, 2017

(87) PCT Pub. No.: WO2016/120384
PCT Pub. Date: Aug. 4, 2016

(65) Prior Publication Data

US 2018/0031347 A1 Feb. 1, 2018

(30) Foreign Application Priority Data

Jan. 28, 2015 (SE) ..... 1550084

(51) Int. Cl.
*F41B 5/20* (2006.01)
*F41B 5/14* (2006.01)

(52) U.S. Cl.
CPC ..... *F41B 5/1426* (2013.01)

(58) Field of Classification Search
CPC ..... F41B 5/1426
See application file for complete search history.

(56) References Cited

U.S. PATENT DOCUMENTS

| | | | | |
|---|---|---|---|---|
| 3,670,712 | A | 6/1972 | Izuta | |
| 4,615,327 | A | 10/1986 | Saunders | |
| 5,735,257 | A * | 4/1998 | Walk | F41B 5/1426 124/89 |
| 5,975,070 | A | 11/1999 | Sands | |
| 6,817,352 | B1 | 11/2004 | Saunders | |
| 8,783,238 | B2 * | 7/2014 | Julian | F41B 5/1426 124/86 |
| 2006/0283435 | A1 | 12/2006 | Pellerite | |

* cited by examiner

*Primary Examiner* — John Ricci
(74) *Attorney, Agent, or Firm* — Bergman & Song LLP; Michael Bergman

(57) ABSTRACT

The invention relates to a vibration damper (35) for archery bows. The vibration damper comprises a housing (36) extending along an axis (X) and forming at least one chamber (37, 38, 39, 40), wherein the at least one chamber is partially filled with granular solid material (9). The housing is formed by a stack of two or more bowl-shaped parts (1, 2, 4) arranged along the axis, wherein the at least one chamber is closed by the subsequent part in the stack. The stack of parts is held together by a central attachment device (41) extending along the axis, to close the at least one chamber, such that the at least one chamber forms an open space circumventing the central attachment device.

11 Claims, 8 Drawing Sheets

VIBRATION DAMPER

The present application is a U.S. National Stage Entry under 37 U.S.C. § 371 of international application PCT/EP2016/051805, having an international filing date of Jan. 28, 2016, and published as WO 2016/120384, which in turn claims priority to Swedish patent application SE 1550084-6, filed on Jan. 28, 2015, the disclosures of which are herewith incorporated by reference in their entireties.

TECHNICAL FIELD

The invention relates to vibration dampers, in particular to a vibration damper and combined weight for archery bows and similar devices. The vibration damper may be mounted on the archery bow, e.g. on the end of a stabilizer or on the bows center portion called the riser. The vibration damper may be used to absorb vibrations and recoil that occurs in the bow when the arrow is fired.

BACKGROUND

Vibration dampers are common on bows for both competition and hunting. There are generally two types of bows, recurve bows and compound bows, where it is common to mount vibration dampers. The vibration damper is used to dampen vibrations and recoil that occurs in the bow when the arrow is fired. Most common is vibration dampers of rubber in combination with a homogeneous metal weight. It is common to attach a weight in the outer end of the stabilizer with the rubber damper between the homogeneous weight and the stabilizer. The other end of the stabilizer is attached to the bows center portion called the riser. The stabilizer is a spacer element, usually made of light weight rigid material that you put between the bow riser and the weight to distance the weight from the bow and provide a greater moment of inertia that prevents the rotary and flexing movement of the bow during the aiming and shots. The vibration damper can also be mounted directly to the bow riser.

On recurve bows there are limb vibrations from the outer ends of the bow where the string is attached. Vibration dampers on the stabilizer reduce vibrations in the limbs. Vibration dampers of rubber in combination with a solid metal weight are usually quite rigid and are poor absorbers of low frequency vibrations in the limbs. If you choose a soft rubber damper in combination with a solid metal weight on the end of the stabilizer the weight will move because of the small tremors that occurs during aiming. If the weight moves during aiming it results in poor stability.

There are also examples of vibration dampers comprising a chamber that is filled with mercury or other liquids, possibly in combination with metal bodies. A vibration damper partially filled with a liquid such as mercury does not give stability during aiming when the liquid moves during aiming. A vibration absorber consisting of a metal body surrounded by a fluid or oil in a housing is also not good at damping low frequency vibrations, for example in a recurve bow limbs.

SUMMARY OF THE INVENTION

The object of the invention is to reduce some of the shortcomings of available vibration dampers and to provide an improved vibration damper for archery bows and the like.

Thus the invention relates to a vibration damper for archery bows. The vibration damper comprises a housing extending along an axis and forming at least one chamber, wherein the at least one chamber is partially filled with granular solid material. The housing is formed by a stack of two or more bowl-shaped parts arranged along the axis, wherein the at least one chamber is closed by the subsequent part in the stack. The stack of parts is held together by a central attachment device extending along the axis, to close the at least one chamber, such that the at least one chamber forms an open space circumventing the central attachment device.

Thereby an improved vibration damper is provided. The hollow body partially filled with granules of a solid material is advantageous since the grains of solid material moves only at excessive vibration or rapid movement, but is still at small shakes or slow movement when aiming. The construction with a stack of two or more bowl-shaped parts arranged along the axis is advantageous since it facilitates fabrication, assembly and disassembly of the device. Further, the stack may thereby be held together by such a central attachment device. This is particularly advantageous since this makes it possible to make the housing very light weight, in the form of a shell, and to minimize the weight of the attachment device to a centrally located lightweight device extending throughout the housing. This design is very weight efficient and saves weight especially when compared with a design with threads or other similar solutions located at the outer walls of the housing to keep parts together.

The vibration damper may comprise two or more chambers and the two or more chambers may be separated from one another in the axial direction by a separating wall. Each such chamber may be partially filled with granular material. This is particularly advantageous since the granular material in two or more chambers may be separated in the axial direction. Thereby, the effect of the granular material moving in the axial direction is reduced. If the vibration damper is tilted, the granular material may be kept in place by the separating wall instead of accumulating at one axial end of the vibration damper.

The stack may comprise a first and a second end part defining a first and second end portion of the damper, and at least one middle part, wherein the at least one middle part comprises the separating wall. Thus the vibration damper may be fabricated and assembled in a modular fashion. The size and weight of the vibration damper may be defined by the number of middle parts assembled in the stack. The housing may thus divided into several separate sections with separate chambers partially filled with steel balls depending on the total weight you want on the damper. The damper design is modular and built on with a section for each desired weight range you want. Also the cost of fabrication may be held low while making it possible to assemble a wide range of sized of vibration dampers. An advantage of adding further middle parts when the weight of the damper needs to increase is that the diameter of the damper may still be the same.

The first and/or second end parts may be formed as dome shaped parts. A basic form of the vibration damper may comprise these two parts forming a spherical or near-spherical chamber. This shape makes the center of gravity of the granular material to move marginally if the damper is tilted up or down.

The at least one middle part may be formed as a cylindrical bowl comprising a bottom forming the separating wall. Thus the separating wall of each chamber may be provided in a simple way in the stack.

Each part in the stack may be provided with a tubular protrusion extending along the length of the part in the axial direction forming a through hole through the stack for receiving the central attachment device. Thus the assembly of the device is facilitated since granular material may be filled into the part and the parts may be stacked and assembled while reducing the risk of granular material being lost by leaking from the bowl shaped part.

A production technical advantage of the device is that each part forming a bowl-shaped vessel may be filled separately with the right amount of granular material and handled before they are stacked into a finished damper. Similarly, it is easy to handle the granular material if you wish to dismantle the damper to change the amount of granular material in a chamber.

An elastic sealing element may be provided between each part in the stack, to sealingly close the chamber at an outer circumference. Thus the sealing of the chambers of the vibration damper is maintained to reduce the risk of granular material being lost by leaking from the chambers, and an elasticity may be provided in the device to reduce the vibration damper to crack open if subjected to blows, such as if dropped to the floor. The sealing element may be a rubber seal, e.g. a rubber o-ring. The outside walls of the housing may be thin and only slightly thicker than the sealing element that seals between each part.

Each part in the stack may be provided with a V-shaped groove for receiving the respective elastic sealing element, and wherein the subsequent part in the stack is provided with a corresponding V-shaped groove for receiving the elastic sealing element. The seal is in a V-groove with much material in the side walls at the bottom of the groove that holds the seal, giving a strong design of the groove. When the rubber seal is compressed in the groove it keeps the two housing sections together radially. Movements and wear in the joint between the sections is eliminated and the joint becomes tight and elastic. The assembly of the vibration damper may be facilitated and the respective parts aligned by the combination of the grooves and the sealing element. Also a certain elasticity of the device is provided by means of elastic deformation of the sealing element in the V-shaped groove.

The central attachment device may comprise a light-weight rod with a small diameter with respect to the diameter of the device. It may comprise a threaded rod in engagement with axially outer first and second parts of the stack for providing releasable closure of the at least one chamber. Thus a simple, effective and light weight assembly and closure of the device and chambers may be achieved.

The housing may be formed in a light weight material such as plastics, or aluminum. Thus the housing only adds a limited mass to the vibration damper.

The granular material may comprises material having a high specific weight, such as metal, preferably steel, balls. Thus the weight of the granular material may be a substantial part of the weight of the vibration damper.

The vibration damper may comprise a housing with low weight, for example made of injected molded plastic, which is partly filled with granules of a solid material with high specific weight, such as small metal or steel balls. The housing may also be manufactured with a thin wall of aluminum or another lightweight metal. The lightweight housing thus makes the most of the damper weight is made up of the granules. When the damper is mounted on the outer end of a bow stabilizer an advantage of this is that the housing of the damper should not bring any appreciable weight to the end of the stabilizer.

The invention further relates to an archery bow comprising a vibration damper as disclosed herein, optionally comprising a stiff stabilizing rod mounted to the bow for attaching the vibration damper.

BRIEF DESCRIPTION OF DRAWINGS

Various embodiments of the invention will now be described with reference to the appended drawings, where.

DETAILED DESCRIPTION OF EMBODIMENTS

Figure 1:
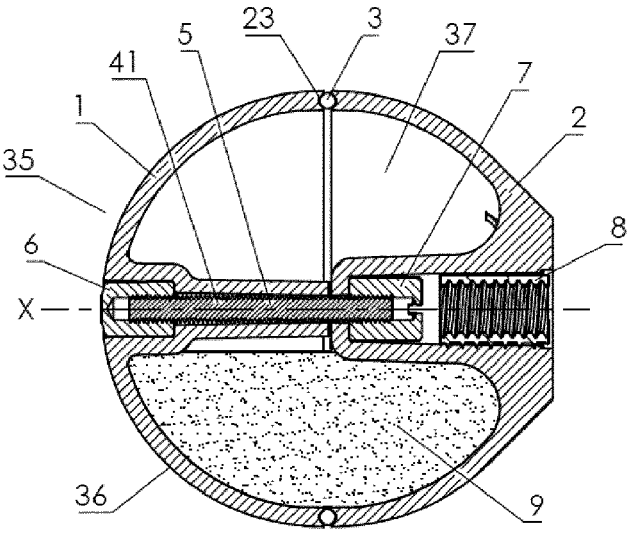
FIG. 1 shows a cut through of a vibration damper according to a first embodiment with one chamber.

The vibration damper 35 shown in FIG. 1 comprises of a housing 36 made by two bowl shaped section parts, a first dome-shaped front section part 1 and a second dome-shaped rear section part 2, arranged along an axis X. Between the parts 1 and 2 there is a sealing 3 located in sealing grooves 23. The parts 1 and 2 are held together by an attachment device 41 comprising a threaded rod 5 located in the centre of the damper housing, along axis X. A first nut 6 is fixed in the first front section part 1. The threaded rod 5 is screwed into the first nut 6 and tightened with a second nut 7, located in the second rear section part 2, forming a central attachment device 41. The attachment device is tightened so that the sealing 3 is compressed making a sealed chamber 37. The chamber is open around the central attachment device, circumventing the central attachment device, and is partially filled with granular solid material in the form of steel balls 9. The second part 2 has an internal threaded bushing 8 assembled from the outside. The thread of this bushing is for mounting the damper on a bow stabilizer or bow riser.

The amount of granular solid material in the chamber may be e.g. 10-90% of the chamber volume, such as 20-60%, 30-40%, 50 or 60%. The amount of granular solid material in the chamber(s) may be chosen depending on the frequency and/or amplitude of the vibration or impulse that is sought to be dampened. For a higher frequency or smaller amplitude, the amount of material may be higher, above 50% up to 90%. For a medium high frequency and amplitude the amount of material may be below 50%, or 30-40%. The granular solid material may comprise steel balls having diameters in the range of 0.05 mm-1.0 mm, such as around 0.2 mm. The size distribution of the steel balls may be within this range, or may be more narrow, such as within 10% or 5% from a mean diameter.

Figure 2:
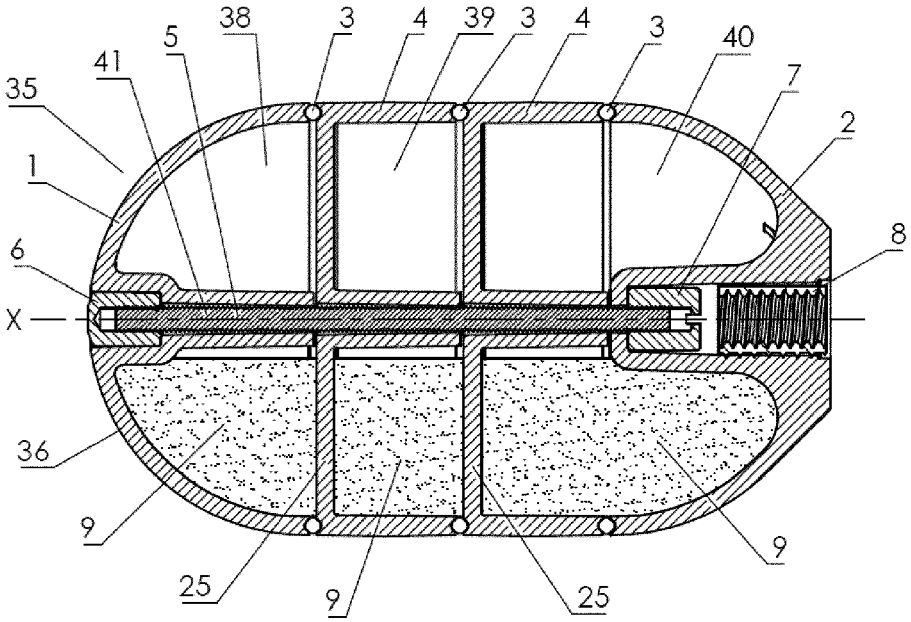
FIG. 2 shows a cut through of a vibration damper according to a second embodiment with three chambers.

The vibration damper shown in FIG. 2 comprises similar parts as shown FIG. 1 with the addition of two middle section parts 4 and additional sealings 3. The assembled housing is thus divided into three separate sealed chambers 38, 39 and 40. The three chambers are partially filled with granular solid material in the form of steel balls 9. The configuration in FIG. 2 is just an example and it's possible to add any number of middle section parts 4 and have a corresponding additional number of sealed chambers in the damper.

Figure 3:
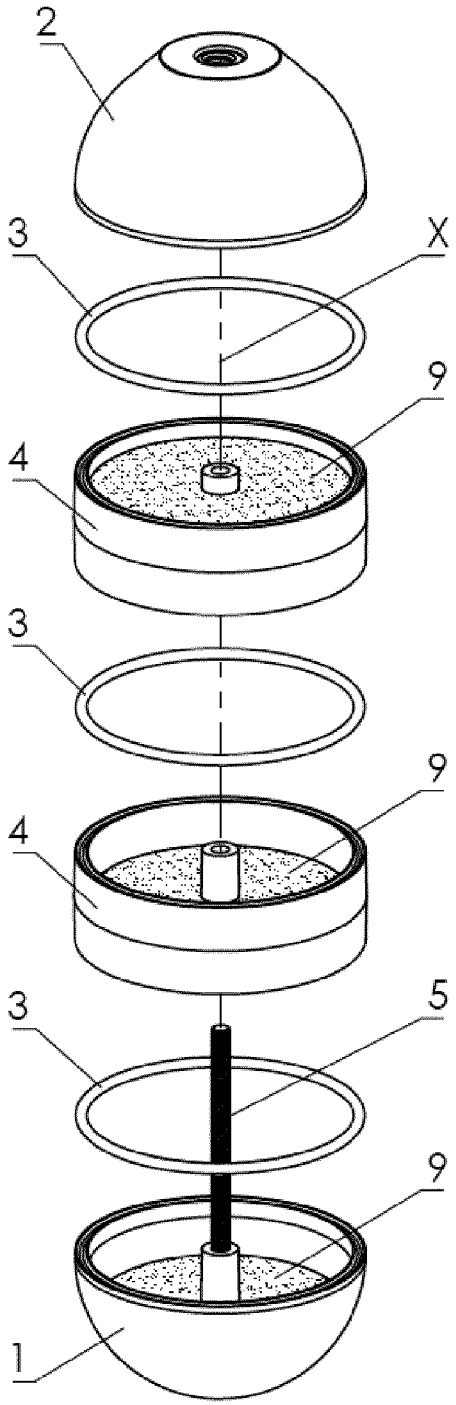
FIG. 3 is an exploded view of the vibration damper showed in FIG. 2 showing the easy handling and assembling of sections filled with granular material.

FIG. 3 shows an exploded view of a vibration damper as shown in FIG. 2. The damper comprises a stack of bowl-shaped parts, i.e., from below, a first front section part 1, two middle section parts 4 and a rear section part 2. The parts are arranged along the axis X and separated by elastic sealing elements 3 in the form of o-rings. The bowl shaped first front section part 1 and the two middle section parts 4 are partially filled with granular solid material in the form of steel balls 9 and then assembled to a vibration damper by means of the central attachment device comprising the threaded rod 5, extending along the axis.

Figure 4:
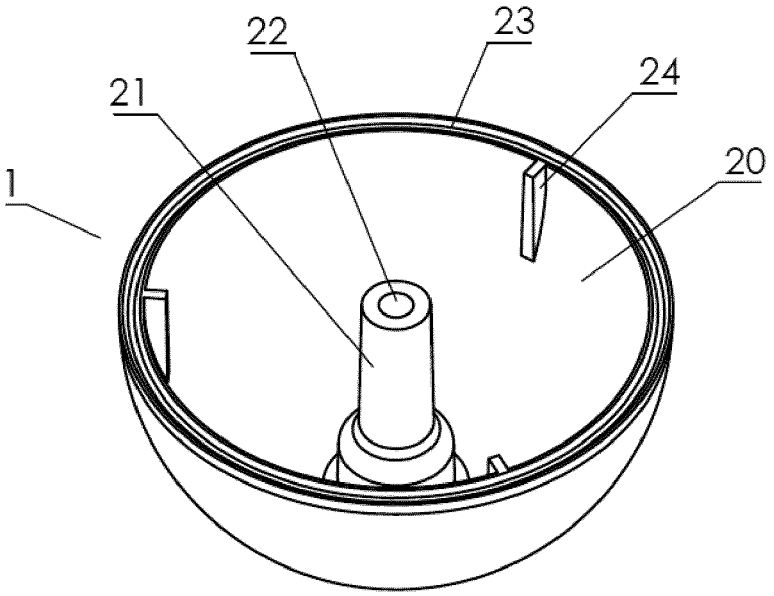
FIG. 4 shows an example of a front section part of the damper housing.

The front section part 1 in FIG. 4 has a spherical inside shape 20 forming bottom and side walls. It has a thin wall made of light weight material, like injected molded plastic. The material may also be other light weight materials as aluminum. Inside in the centre it has a tube shaped protrusion 21, starting from the bottom and extending about the same height as the side walls, with a through hole 22. The through hole 22 has about the same diameter as the threaded screw rod 5 except for the department for the nut 6 where the diameter increases. On the outside wall edge there is a V-shaped groove 23 for receiving the sealing 3. The part comprises mating protrusions 24. Thanks to this design the bowl shaped part 1 may easily be filled and handled with steel balls.

Figure 5:
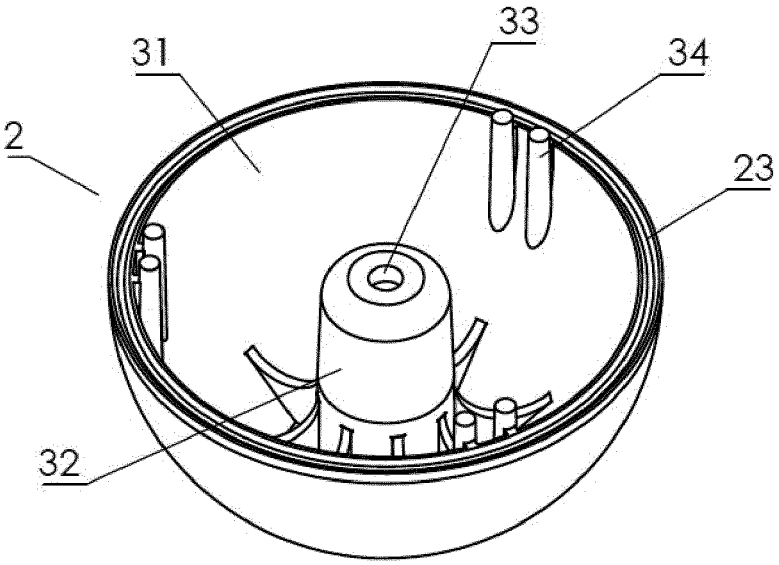
FIG. 5 shows an example of a rear section part of the damper housing.

The rear section part 2 in FIG. 5 has a spherical to conical inside shape 31 forming bottom and side walls. It has a thin wall made of light weight material, like injected molded plastic. The material can also be other light weight materials as aluminum. Inside in the centre it has a cylindrical hollow shaped protrusion 32 starting from the bottom and extending about the same height as the side walls. The protrusion 32 is hollow to receive the central attachment device, and comprises a recess accessible from the outside making a compartment for the nut 7 and the threaded bushing 8 assembled from the outside. Inside on the top of the hollow protrusion 32 there is a through hole 33 with about the same diameter as the threaded screw rod 5. On the outside wall edge there is a V-shaped groove 23 for the sealing 3. The part comprises a pair of mating protrusions 34 for mating with mating protrusions of other parts in the stack.

Figure 6:
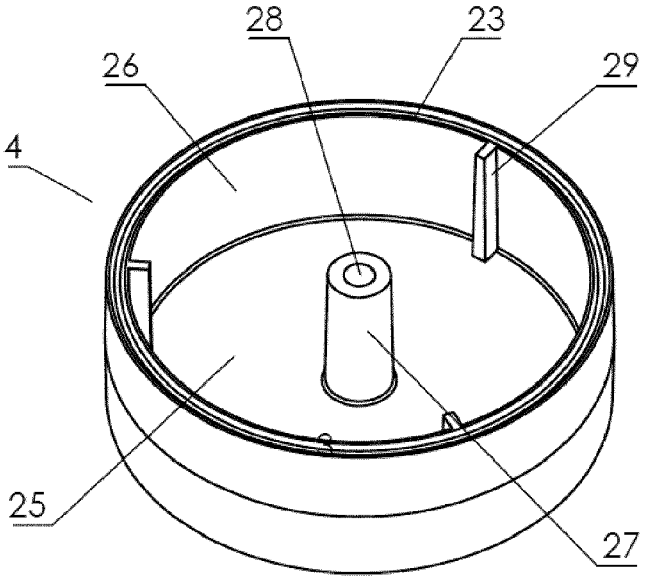
FIG. 6 shows an example of the inside of a middle section part of the damper housing.
Figure 7:
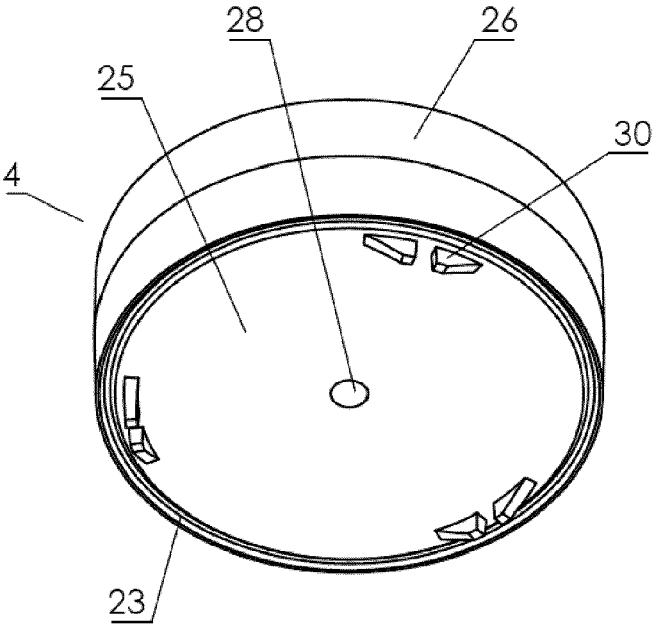
FIG. 7 shows an example of the outside of a middle section part of the damper housing.
Figure 8:
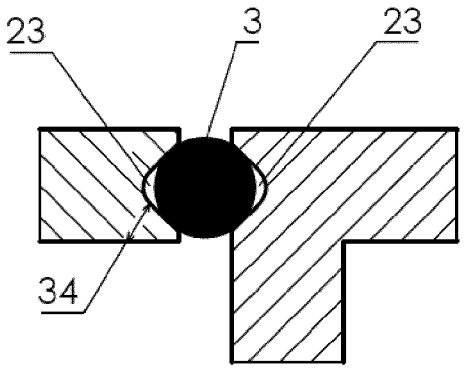
FIG. 8 shows a magnified cut through the V-shaped sealing grooves with a sealing element.

The middle section part 4, showed inside in FIG. 6 and outside FIG. 7, has a bottom 25 and side walls 26. The bottom 25 forms a separating wall when assembled in a stack. The bottom and walls are thin and made of light weight material like injected molded plastic. The material may also be other light weight materials as aluminum. Inside in the centre it has a tube shaped protrusion 27, starting from the bottom and extending about the same height as the side wall 26, with a through hole 28. The through hole 28 has about the same diameter as the threaded screw rod 5. The part comprises forward and backward oriented mating parts 29 and 30 for mating with parts 1 or 2, or to another middle part 4. The mating parts 29 and 30 are useful both because they assist in mating the parts correctly with each other and because they prevent the parts from rotating with respect to each other. This especially useful since it prevents the screw rod 5 from being unscrewed. Thanks to this design the bowl shaped part 4 may easily be filled and handled with steel balls. The elastic sealing 3 and sealing grooves 23 are showed magnified as a cut view in FIG. 8. The sealing groove 23 is a V-shaped design with robust side walls with a large amount of material on each side 34, e.g. when compared with a corresponding recess with rectangular cross-section. The sealing may be a standard rubber o-ring but it may alternatively be custom made in other shapes and in other elastic materials. When the sealing is compressed in the V-shaped sealing grooves it keeps the mating parts together radially. The joint between the mating parts is preferably elastic and waterproof and reduces the risk of granular material leaking from the chamber.

The threaded rod 5 shown in FIGS. 1, 2, 4, 11 and 14 keeps the housing parts together and keeps the sealing 3 compressed. The rod 5 is made of steel with high tensile strength and small diameter. The rod 5 may alternatively be made of other materials with high tensile strength. The rod 5 may also be made of a tube. Instead of the design with a threaded rod 5 and nuts 6 and 7 to keep the part together the central attachment device may be achieved in alternative ways. Rod 5 and nut 6 may be exchanged for a long screw where the screw head is in position of present nut 6. Rod 5 and nut 7 may be exchanged for a long screw where the screw head is in position of present nut 7. The screw replacing rod 5 and nut 7, as described, may be self tapping and screwed into hole 22 in front section part 1 without the need of nut 6. The screw replacing rod 5 and nut 7, as described, may have a screw head diameter smaller than the inside hole of the threaded bushing 8. A smaller screw head, as described, makes it possible to assemble the screw through the threaded bushing 8. If rod 5 and nut 6 is exchanged for a long screw, as described, there is an option to join nut 7 and the threaded bushing 8 to one part.

Figure 9:
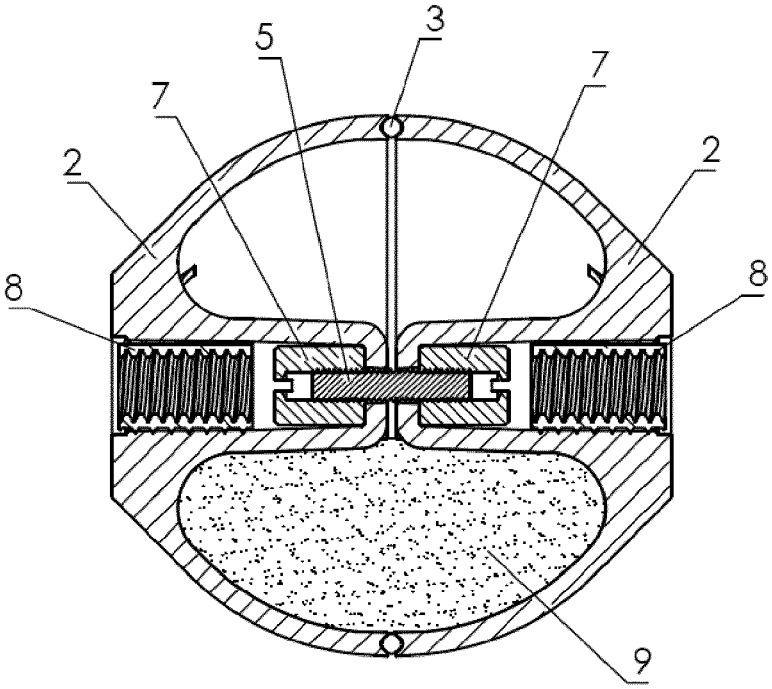
FIG. 9 shows a cut through of an alternative embodiment of a vibration damper with one chamber.

FIG. 9 shows a configuration where the housing comprises of two rear section parts 2 with threaded bushings 8, with a sealing 3 between the two parts 2 and a central attachment device in the form of a threaded rod 5 and two nuts 7 holding the housing together. The housing is partially filled with solid granular material in the form of steel balls 9. This configuration gives a mounting thread in both ends of the damper for mounting on the bow stabilizer or bow riser and additional mounting of weights, dampers or accessories on the other end. As described earlier there are options to the threaded rod 5 and the nut 7. As described the rod 5 and the nut 7 may be replaced by a screw with a screw head on one side. There is also an option to combine the nut 7 and threaded bushing 8 into one part on one side.

Figure 10:
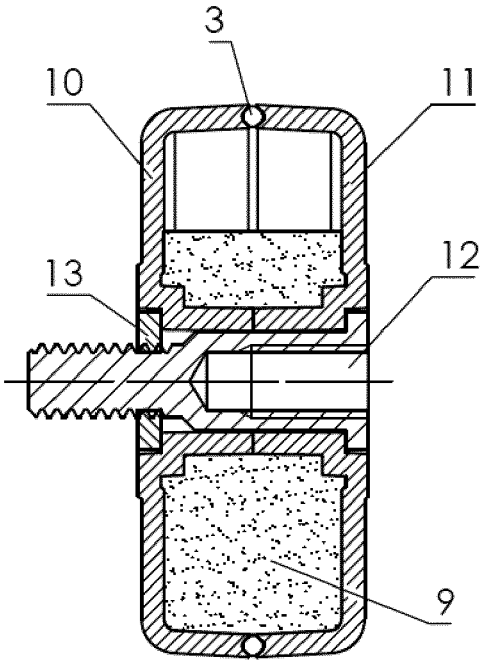
FIG. 10 shows a cut through of an alternative embodiment of a vibration damper with one chamber.

FIG. 10 shows a configuration where the housing comprises of two bowl-shaped halves 10 and 11. These parts may be similar to the front section 1 and middle section 4 described in previous figures, and they are provided with a sealing 3 between the two parts 10 and 11. In this configuration the threaded rod 5 is replaced by a rod 12 with internal thread on one side and an external threaded pin on the opposite side, forming a central attachment device in cooperation with a nut 13 keeping the parts 10, 11 together. The housing is partially filled with steel balls 9. The internal thread of the rod 12 is for mounting on the bow stabilizer or bow riser. The external threaded pin of the rod 12 is for assembling of additional dampers or weights.

In FIGS. 11-14 a further embodiment of the invention is shown. This embodiment differs from the embodiments above in that a supplementary partition wall 42 is positioned between the rear end part 2 and the adjacent open end of the at least one middle part 4. This is useful as it facilitates filling of both the relevant middle part 4 and the rear end part 2. The chambers 38 and 39 are filled one by one and are sealed by the separation wall provided by the bottom 25 of the subsequently arranged chamber. This method of filling the chambers one by one of course functions as long as the recently filled chamber may by facing upwards until the next chamber is arranged to seal the filled chamber. A problem arises when the last chamber, i.e. the chamber 40 of the rear end part 2 shown in FIG. 2, needs to be filled above a certain degree of filling. Namely, this may not be made due to the fact that end portion 2 includes a certain void space into which the filled granular solid material 9 may migrate after assembly such that the degree of filling will be reduced. This is hence solved by the inclusion of the supplementary partition wall 42, which allows the chamber 49 of the adjacent middle part 4 to be sealed before attaching the rear end part 2 to said middle part 4. Hence, the supplementary partition wall 42 divides the chamber 40 (shown in FIG. 2) into two sub-chambers 49 and 50. These sub-chambers 49 and 50 may be individually filled before assembly, the supplementary partition wall 42 sealing chamber 49 such that only the chamber 50 of the end part 2 needs to be face-up before and during assembly.

Figure 11:
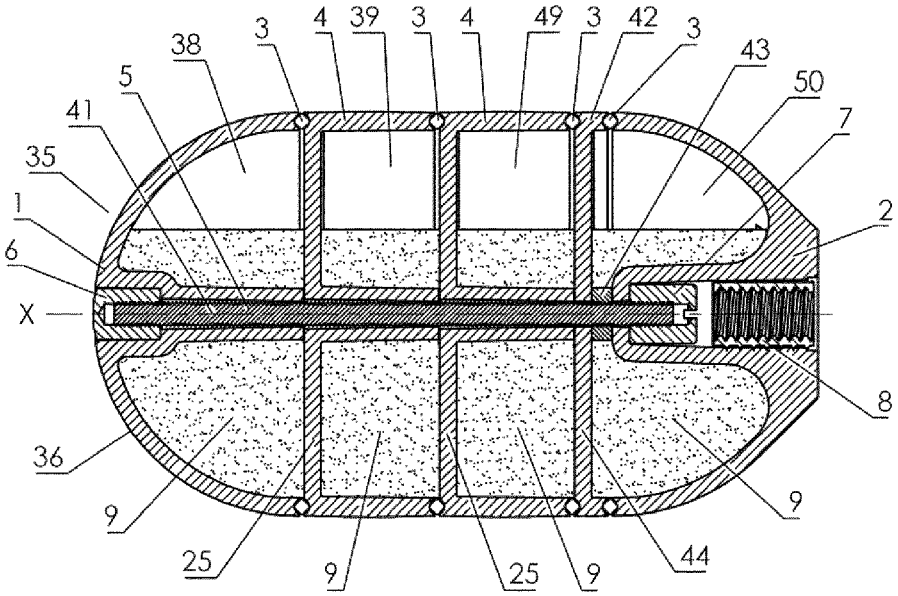
FIG. 11 shows a cut through of an alternative embodiment of a vibration damper with four chambers.
Figure 14:
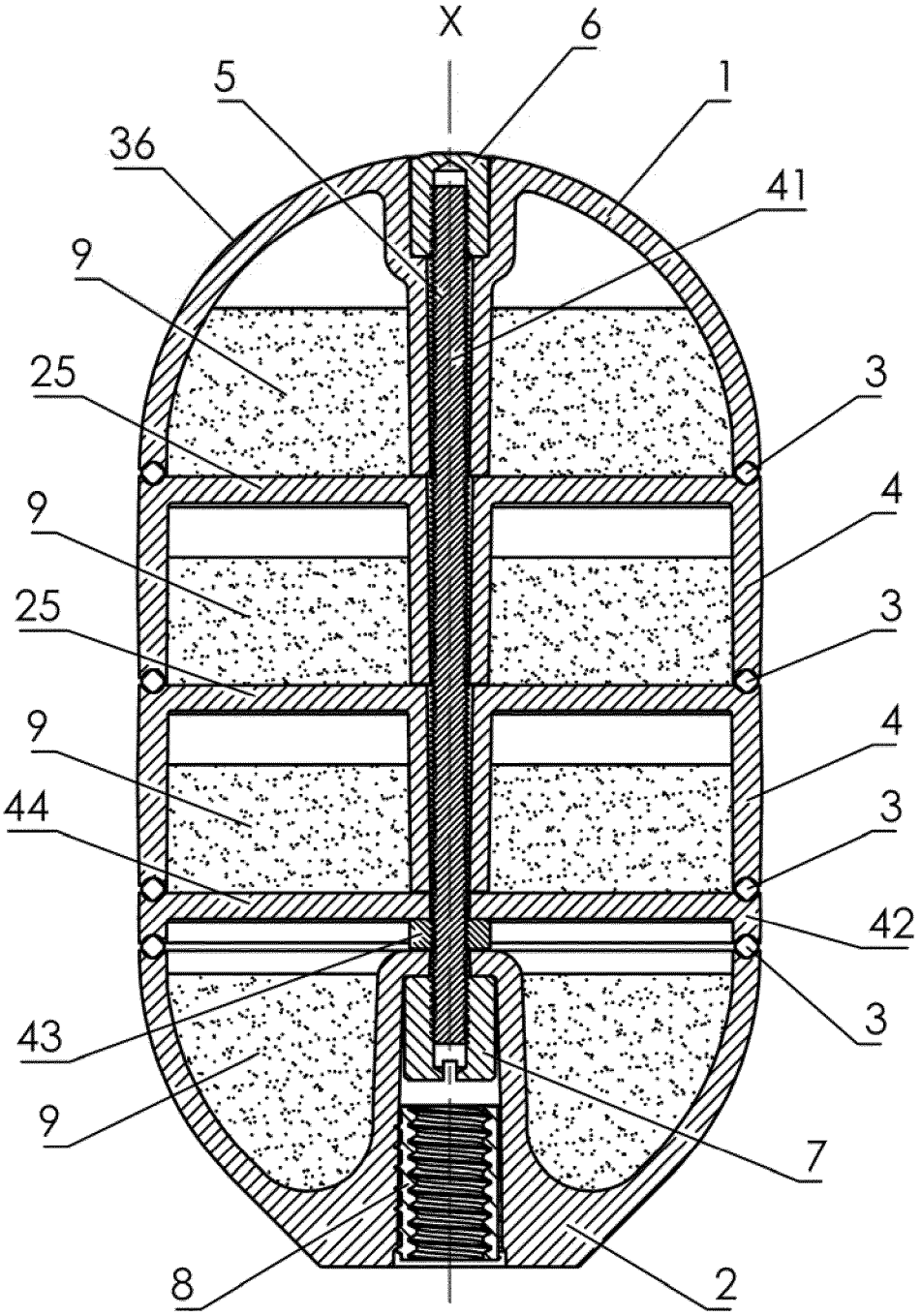
FIG. 14 shows a cut through of an alternative embodiment of a vibration damper with four chambers.

As is shown in FIGS. 11 and 14 the supplementary partition wall 42 is sealed by an O-ring 3 to both the rear end part 2 and the adjacent middle part 4. The supplementary partition wall 42 is sealed by the provision of a nut 43, which is arranged around the central attachment device 41 in the form of a threaded rod 5 so as to assure the attachment of the supplementary partition wall 42. The supplementary partition wall 42 has an outer portion 45 having an extension in the axial direction that corresponds to the axial extension of the nut 43. In the middle of a disc shaped portion 44 of the supplementary partition wall 42 a through hole 46 is arranged for allowing the central attachment device 41 to pass through it. The nut 43 will seal the area around through hole 46 such that the granular solid material 9 will not be allowed to passed through it.

Figure 12:
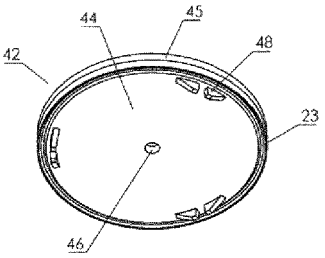
FIG. 12 shows the front of a supplementary partition wall.
Figure 13:
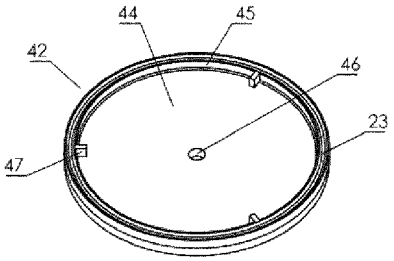
FIG. 13 shows the rear of a supplementary partition wall.

In FIGS. 12-13 the supplementary partition wall 42 is shown from the front and rear, respectively. The supplementary partition wall 42 has female parts 48 on the front side and male parts 47 on the rear side. Both sides are provided with a V-shaped groove 23 for receiving a respective sealing 3. The mating parts 48 and 47 are useful both because they assist in mating the parts correctly with each other and because they prevent the parts from rotating with respect to each other. This is especially useful since it prevents the nut 43 from being unscrewed. Subsequently, the chamber 50 of the end part may be filled with granular solid material 9 and attached, face up, to the sealed chambers of the vibration damper.

The supplementary partition wall 42 is thus provided with front and rear faces that match the other parts of the vibration damper. For instance, the supplementary partition wall 42 may be arranged between the front section part 1 and the rear section part 2 of the embodiment shown in FIG. 1. This may be useful as it would allow the chamber 37, which of course would be divided into two sub-chambers by the supplementary partition wall 42, to be filled to any desired degree.

The vibration damper is mounted to an archery bow or the like, for reducing vibrations and recoil when an arrow is fired. During operation of the vibration damper, the housing follows the movements of the bow. Upon slow movement, such as during aiming, the solid granular material is still in the housing and the movement is not affected. However, upon rapid movement of the bow, such as during firing and recoil, the solid granular material in the chamber moves relative to the housing. Thus when the stabilizer outer end swings back and forth during at a shot, the housing follows the stabilizer movements while the granular material is almost still in space due to the momentum of the granular material. The energy of oscillation of the vibration damper is dampened by the friction between the steel balls when they hit the inside of the casing. The damper thus acts as a combined vibration dampers and weight, thus replacing traditional rubber dampers in combination with a homogeneous weight.

The invention claimed is:

1. A vibration damper for archery bows comprising a housing extending along an axis and forming at least one chamber, wherein the at least one chamber is partially filled with granular solid material, wherein the housing is formed by a stack of two or more bowl-shaped parts arranged along the axis, wherein the at least one chamber is closed by the subsequent part in the stack, wherein the stack of parts is held together by a central attachment device extending along the axis, to close the at least one chamber, such that the at least one chamber forms an open space circumventing the central attachment device, and wherein each part in the stack is provided with a tubular protrusion extending along the length of the part in the axial direction forming a through hole through the stack for receiving the central attachment device.

2. The vibration damper according to claim 1 comprising two or more chambers and wherein the two or more chambers are separated from one another in the axial direction by at least one separating wall.

3. The vibration damper according to claim 2 wherein the stack comprises a first and a second end part defining a first and second end portion of the damper, and at least one middle part, wherein the at least one middle part comprises the at least one separating wall.

4. The vibration damper according to claim 3 wherein the first and a second end part are open ended and wherein an supplementary partition wall is arranged between the open end of the at least one middle part and the adjacent end part of the first and a second end part.

5. The vibration damper according to claim 3 wherein the at least one middle part is formed as a cylindrical bowl comprising a bottom forming the separating wall.

6. The vibration damper according to claim 1 wherein an elastic sealing element is provided between each part in the stack, to sealingly close the chamber at an outer circumference.

7. The vibration damper according to claim 6 wherein each part in the stack is provided with a V-shaped groove for receiving the respective elastic sealing element, and wherein the subsequent part in the stack is provided with a corresponding V-shaped groove for receiving the elastic sealing element.

8. The vibration damper according to claim 1 wherein the central attachment device comprises a threaded rod in engagement with axially outer first and second parts of the stack for providing releasable closure of the at least one chamber.

9. The vibration damper according to claim 1 wherein the housing is formed in a light weight material such as plastics.

10. The vibration damper according to claim 1 wherein the granular material comprises metal, preferably steel, balls.

11. An archery bow comprising a vibration damper according to claim 1, optionally comprising a stiff stabilizing rod mounted to the bow for attaching the vibration damper.

* * * * *